US006152180A

United States Patent [19]

Yang

[11] Patent Number: 6,152,180

[45] **Date of Patent: *Nov. 28, 2000**

[54] DIVERTER TUB SPOUT BODY

[76] Inventor: Johnny Yang, No. 139-1, Lane 498, Sec.3, Lu Ho Rd., Lu Kang Chen, Chang Hua Hsien, Taiwan

[ * ] Notice: This patent is subject to a terminal disclaimer.

[21] Appl. No.: 09/339,187

[22] Filed: Jun. 24, 1999

[51] Int. Cl.[7] ..... E03C 1/04

[52] U.S. Cl. ..... 137/801; 4/678; 137/119.05

[58] Field of Search ..... 4/678; 137/119.05, 137/801

[56] References Cited

U.S. PATENT DOCUMENTS 6,009,904 1/2000 Yang ..... 137/801

*Primary Examiner*—Gerald A. Michalsky

*Attorney, Agent, or Firm*—Rosenberg, Klein & Lee

[57] ABSTRACT

A diverter tub spout body includes a tubular main portion which has an annular flange extending radially inward from the first end thereof, and a second end which is an open end. The annular flange has a hole defined centrally therethrough and a hose connecting tube extends from the periphery defining the hole of the annular flange so as to be connected to the supply pipe. An outlet portion is connected to the first end of the tubular main portion and communicates with the hole of the annular flange. An aperture is defined through the wall of the tubular main portion and located below the annular flange so that bubbles release via the aperture when immersing the diverter tub spout body into the electroplating bath solution.

2 Claims, 7 Drawing Sheets

DIVERTER TUB SPOUT BODY

FIELD OF THE INVENTION

The present invention relates to a spout body for a tub spout, and more particularly, to an improved diverter tub spout body having an aperture defined through the wall thereof such that the bubbles are released via the aperture when the spout body is immerged into the plating bath solution and the inside of the spout body is completely plated.

BACKGROUND OF THE INVENTION

Referring to FIG. 1, a conventional diverter tub spout body 10 is shown and includes a tubular main portion 22 and an outlet portion 25 connected to the first end of the tubular main portion 22. An annular flange 23 extends radially inward from the inside of the first end of the tubular main portion 22 and a hose connecting tube 24 extends from the inside of the annular flange 23 toward the second end of the tubular main portion 22 so that a hose connected to the supply pipe (both not shown) is connected to the hose connecting tube 24. The outlet portion 25 has a tube 26 for a control switch (not shown) being received therein. In order to prevent the copper or zinc made diverter tub spout body 10 from getting rust, an electroplating process is necessary. When immerging the diverter tub spout body 10 into the electro-plating bath solution 11 as shown in FIG. 2, bubbles 12 are retained in the area between the annular flange 23, the tubular main portion 22 and the hose connecting tube 24 so that the inside of the area cannot be well electroplated. A further process is therefore taken to additionally electro-paint the inside of the area otherwise rust will be found in the area.

The present invention intends to provide a diverter tub spout body which has an aperture defined through the wall of the tubular main portion and is located to communicate with the area between the annular flange, the hose connecting tube so that bubbles release from the aperture and the electro-plating bath solution reaches the inside of the area.

The diverter tub spout body of the present invention resolves the inherent shortcomings of the conventional diverter tub spout body and the inside of the diverter tub spout body is completely electro-plated.

SUMMARY OF THE INVENTION

In accordance with one aspect of the present invention, a diverter tub spout body is provided and includes a tubular main portion having an annular flange extending radially inward from the first end thereof, and a second end which is an open end. The annular flange has a hole defined centrally therethrough and a hose connecting tube extends from the periphery defining the hole of the annular flange so as to be connected to the supply pipe. An outlet portion is connected to the first end of the tubular main portion and communicates with the hole of the annular flange. An aperture is defined through the wall of the tubular main portion and located below the annular flange.

The object of the present invention is to provide a diverter tub spout body which has an aperture defined through the wall of the tubular main portion of the diverter tub spout body to let bubbles release from the aperture when the diverter tub spout body is immerged into the electro-plating bath solution.

Further features of the present invention will become apparent after a careful reading of the detailed description with appropriate reference to the accompanying drawings.

DETAILED DESCRIPTION OF THE PREFERRED EMBODIMENT

Figure 1:
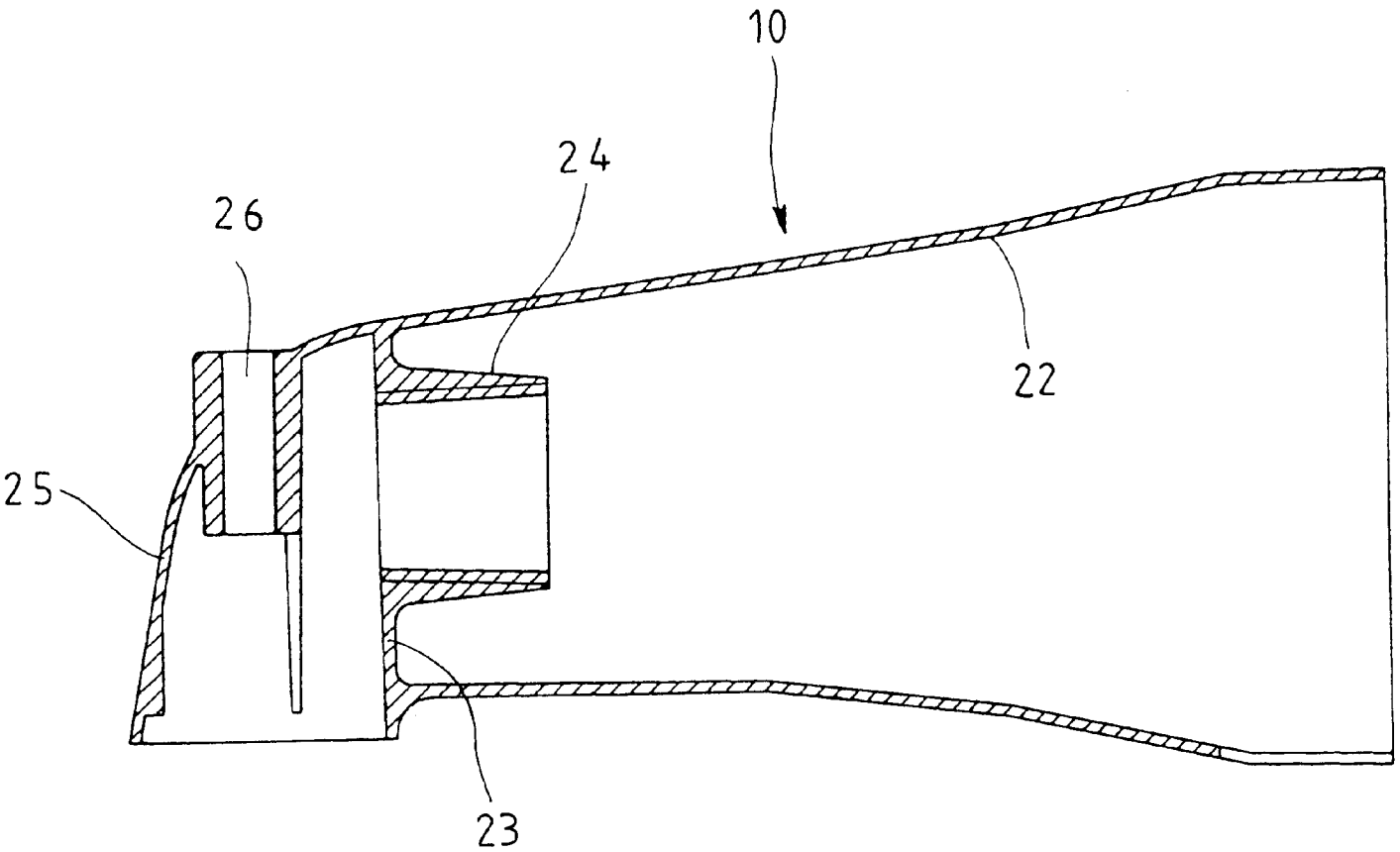
FIG.1 PRIOR ART
FIG. 1 is a side elevational view, partly in section, of a conventional diverter tub spout body.
Figure 2:
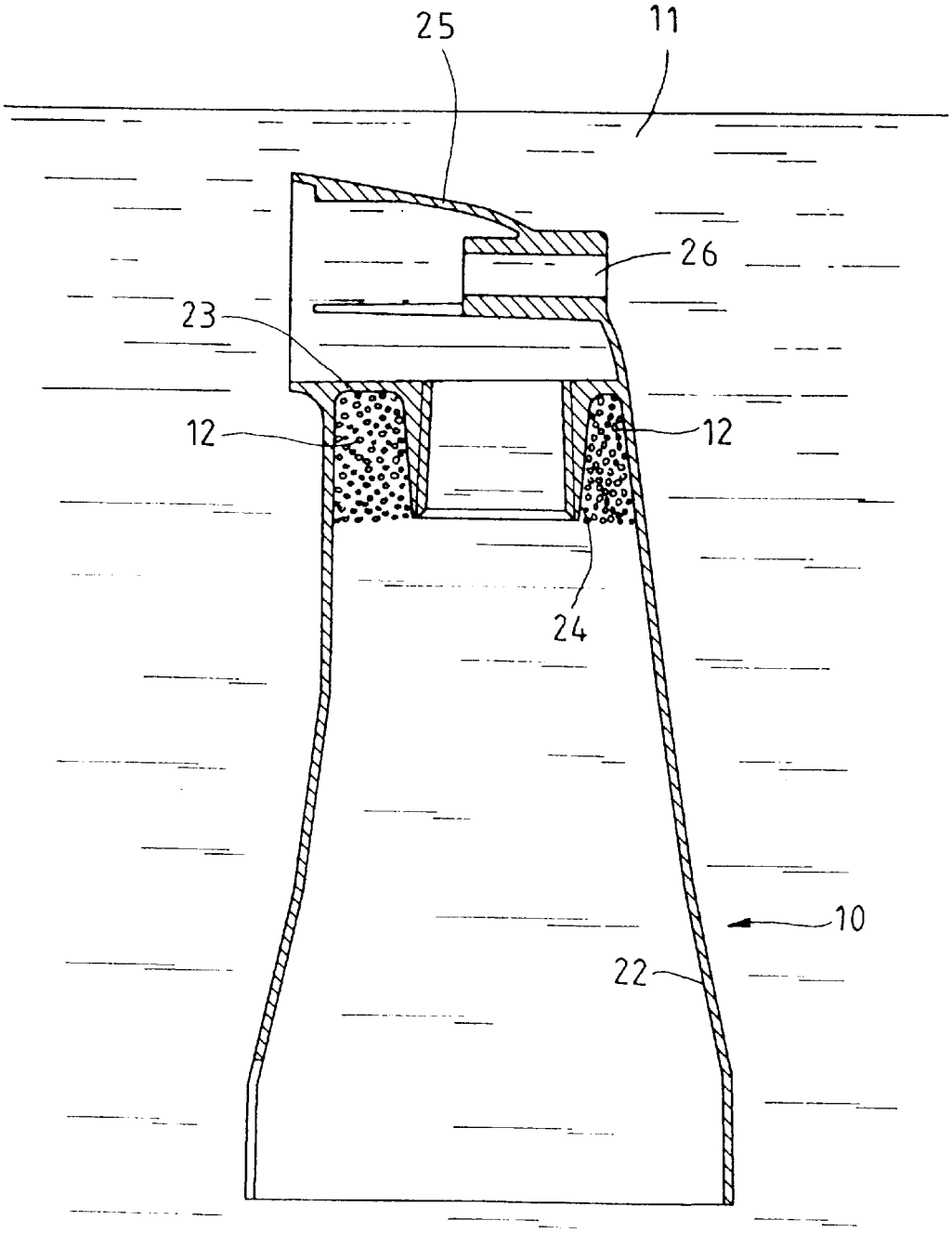
FIG.2 PRIOR ART
FIG. 2 is an illustrative view to illustrate the conventional diverter tub spout body is immerged into the electroplating bath solution.
Figure 3:
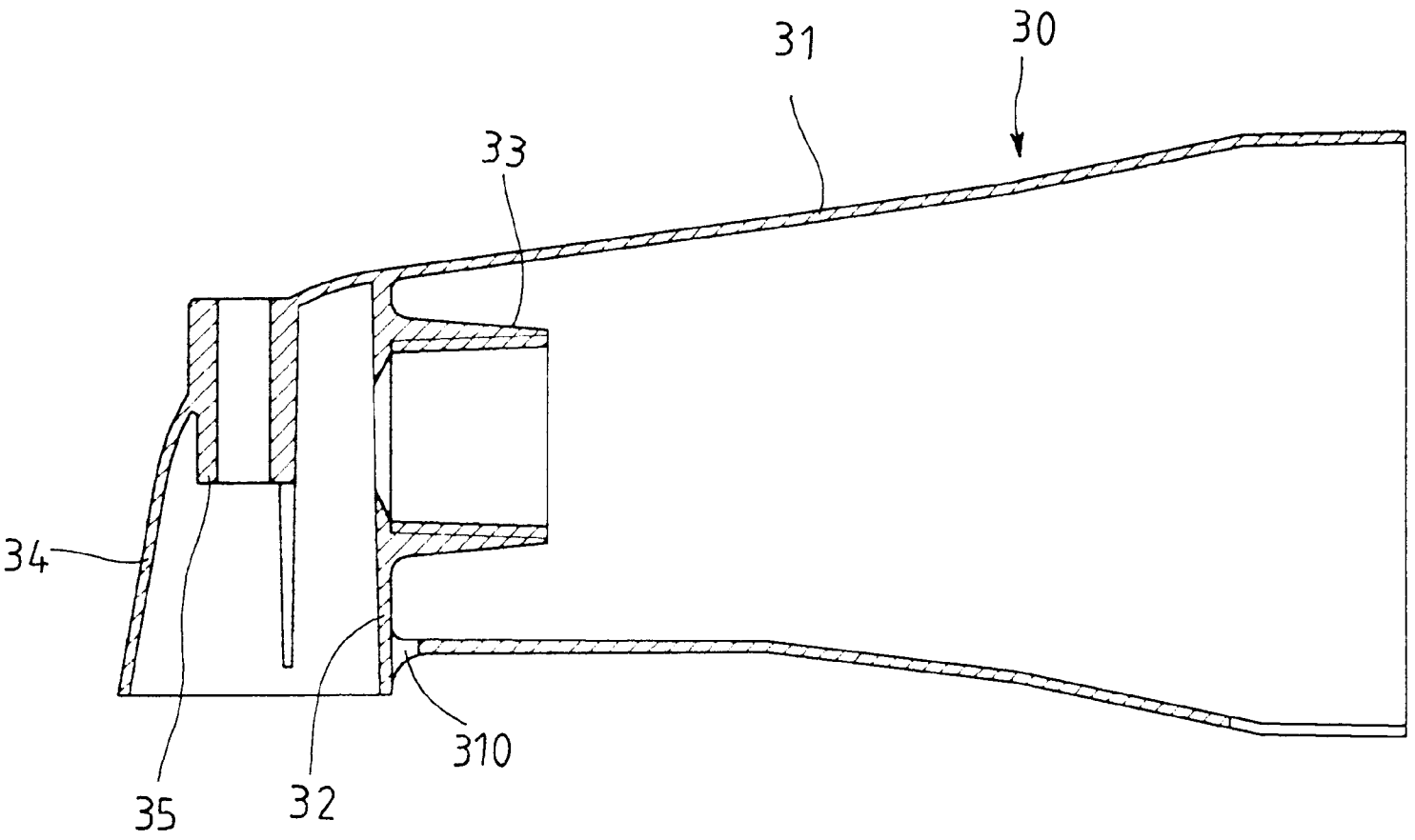
FIG. 3 is a side elevational view, partly in section, of the diverter tub spout body in accordance with the present invention.
Figure 4:
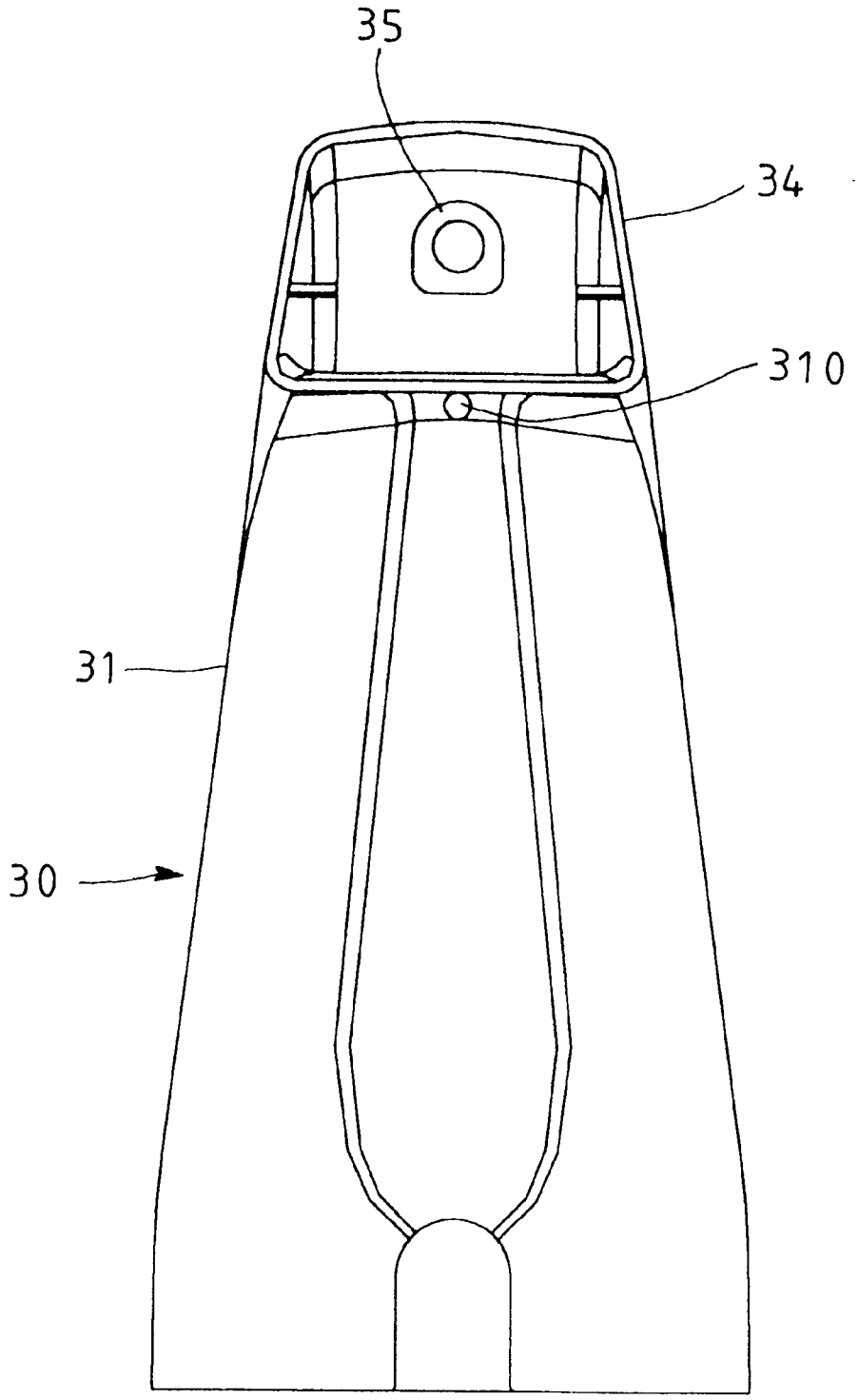
FIG. 4 is a front elevational view so show the position of the aperture through the wall of the tubular main portion of the diverter tub spout body in accordance with the present invention.
Figure 5:
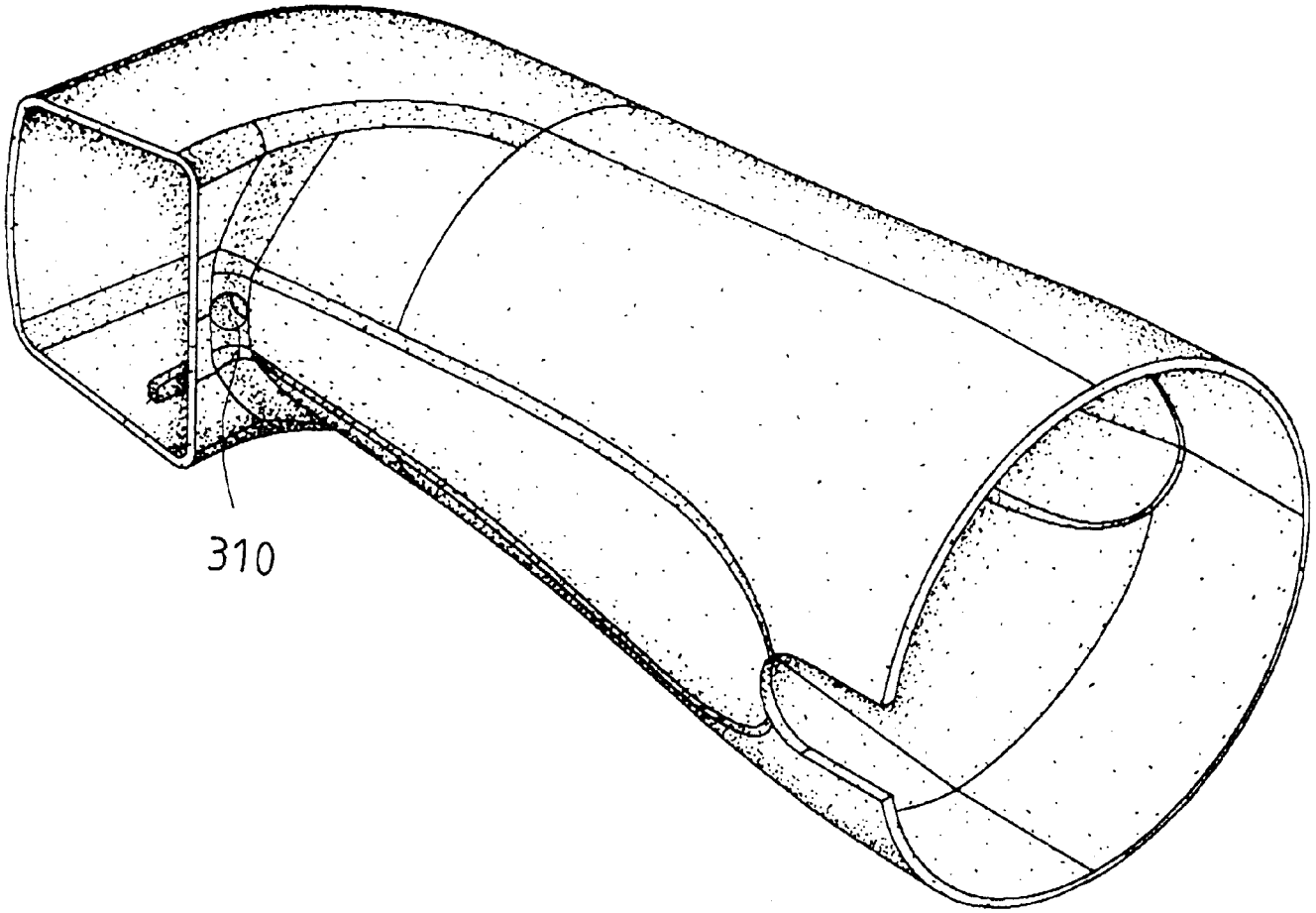
FIG. 5 is a perspective view to show the diverter tub spout body in accordance with the present invention.
Figure 7:
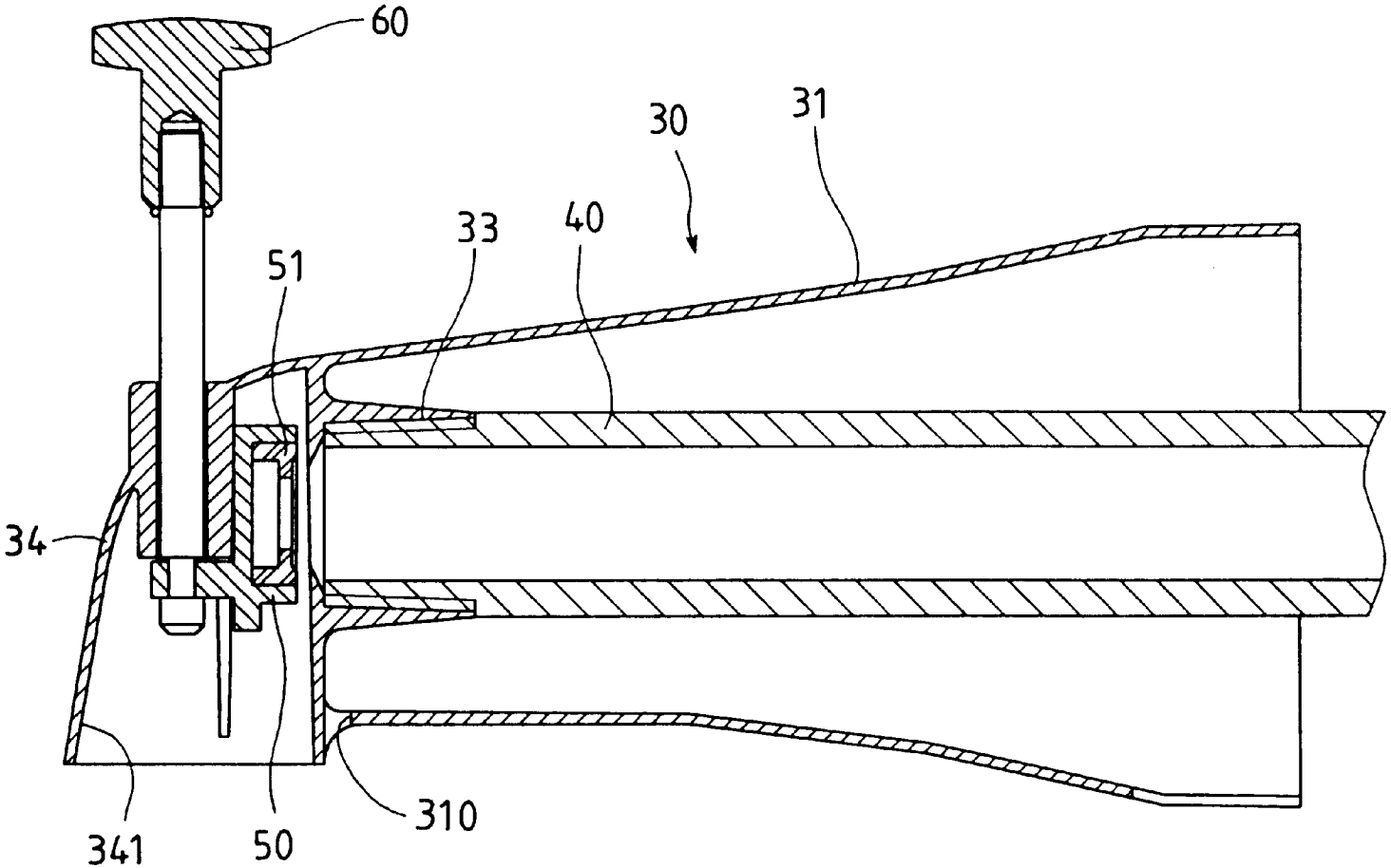
FIG. 7 is an illustrative view to illustrate the diverter tub spout body of the present invention with a control switch means installed thereto.

Referring to FIGS. 3 to 5, the diverter tub spout body 30 in accordance with the present invention comprises a tubular main portion 31 having a first end with an annular flange 32 extending radially inward therefrom and a second end which is an open end. The annular flange 32 has a hole defined centrally therethrough and a hose connecting tube 33 extends from the periphery defining the hole of the annular flange 32. An outlet portion 34 is connected to the first end of the tubular main portion 31 and communicates with the hole of the annular flange 32. Referring to FIG. 7, the hose connecting tube 33 is used to be connected to a supply pipe 40 so that water will flow from the opening 341 of the outlet portion 34 via the hole of the annular flange 32.

Figure 6:
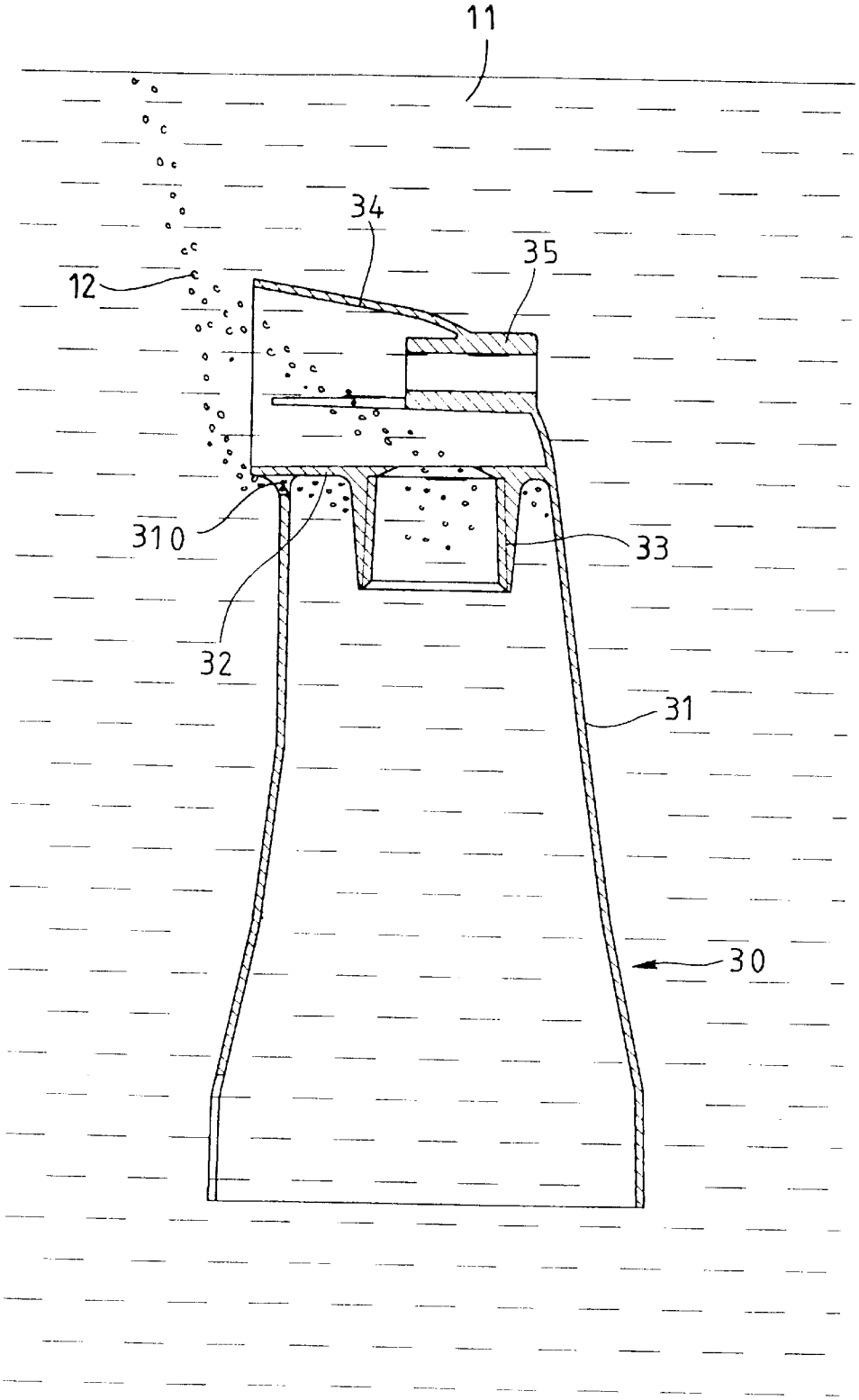
FIG. 6 is an illustrative view to illustrate the diverter tub spout body of the present invention is immerged into the electroplating bath solution.

An aperture 310 is defined through the wall of the tubular main portion 31 and located below the annular flange 32. It is to be noted that the aperture 310 communicates with the annular space defined between the annular flange 32, the hose connecting tube 33 and the wall of the tubular main portion 31. Referring to FIG. 6, when immersing the diverter tub spout body 30 into the electro-plating bath solution 11, most of the bubbles 12 will release from the hose connecting tube 33, the hole of the annular flange 32 and the opening 341 of the outlet portion 34, and the rest of the bubbles 12 release from the aperture 310 and are not retained in the annular space between the annular flange 32, the hose connecting tube 33 and the wall of the tubular main portion 31.

As shown in FIG. 7, the outlet portion 34 has a tube 35 connected thereto and a space is defined between the tube 35 and the annular flange 32. A rubber seal cup 51, a diverter gate 50 are received in the space between the tube 35 and the annular flange 32, and a lift rod 60 is connected to the diverter gate 50 so that the hole of the annular flange 32 is normally sealed by the rubber seal cup 51 and opened by operating the lift rod 60 to remove the rubber seal cup 51 from the hole of the annular flange 32.

The position of the aperture 310 is located below the annular flange 32 and in the abutting area of the outlet portion 34 and the first end of the tubular main portion 31 so that a complete outer appearance can be maintained.

It is to be understood that the above description and drawings are only used for illustrating some embodiments of the present invention, not intended to limit the scope thereof. Any variation and derivation from the above description and drawings should be included in the scope of the present invention.

What is claimed is:

1. A diverter tub spout body, comprising:

a tubular main portion and an outlet portion with a separating annular flange connected between said tubular main portion and said outlet portion, said separating annular flange having a hole formed therethrough for fluid communication between an interior of said tubular main portion and an interior of said outlet portion, a joint being formed between a wall of said tubular main portion enveloping said interior thereof, and an outlet portion wall of said outlet portion surrounding said interior thereof, a hose connecting tube having walls thereof extending from said separating annular flange into said interior of said tubular main portion in surrounding relationship with said hole formed through said separating annular flange, and an aperture formed through said wall of said tubular main portion substantially in proximity to said joint, said aperture defining a fluid communication path allowing a direct fluid communication between said interior of said tubular main portion and an environment surrounding said diverter tub spout body.

2. The diverter tub spout body of claim 1, wherein said fluid communication path is defined at the lowermost area of said tubular main portion wall.

* * * * *